US010660377B2

(12) United States Patent
Randall et al.

(10) Patent No.: US 10,660,377 B2
(45) Date of Patent: May 26, 2020

(54) BRASSIERE AND FRONT PANEL FOR BRASSIERE

(71) Applicant: Mast Industries (Far East) Limited, Kowloon (HK)

(72) Inventors: Tracey Randall, New York, NY (US); Ursula Giovanna Todaro, Glendale, NY (US); Zhenqiang Liu, Kwai Chung (HK); Tara Sweeney, Hoboken, NJ (US)

(73) Assignee: Mast Industries (Far East) Limited, Kowloon (HK)

( * ) Notice: Subject to any disclaimer, the term of this patent is extended or adjusted under 35 U.S.C. 154(b) by 321 days.

(21) Appl. No.: 15/593,557

(22) Filed: May 12, 2017

(65) Prior Publication Data

US 2017/0360118 A1 Dec. 21, 2017

Related U.S. Application Data

(60) Provisional application No. 62/337,027, filed on May 16, 2016.

(51) Int. Cl.
*A41C 3/14* (2006.01)
*A41C 3/00* (2006.01)
(Continued)

(52) U.S. Cl.
CPC ..... *A41C 3/14* (2013.01); *A41C 3/0007* (2013.01); *A41C 3/0057* (2013.01); *A41C 3/02* (2013.01); *A41C 3/128* (2013.01); *A41C 3/142* (2013.01)

(58) Field of Classification Search
CPC ..... A41C 3/14; A41C 3/142; A41C 3/128; A41C 3/0057; A41C 3/0007; A41C 3/02
(Continued)

(56) References Cited

U.S. PATENT DOCUMENTS 1,472,796 A * 11/1923 Lewis ..... A41C 3/124 450/48
2,719,301 A * 10/1955 Witkower ..... A41C 3/10 2/255
(Continued)

FOREIGN PATENT DOCUMENTS

CN 201135143 Y 10/2008
CN 201142941 Y 11/2008
(Continued)

OTHER PUBLICATIONS

Extended European Search Report issued in corresponding EP Application No. 17171153.4, dated Nov. 3, 2017.
(Continued)

*Primary Examiner* — Jameson D Collier
*Assistant Examiner* — Jocelyn Bravo
(74) *Attorney, Agent, or Firm* — Andrus Intellectual Property Law, LLP

(57) ABSTRACT

A brassiere includes bra cups holding a wearer's breasts. A shaping foam layer is sandwiched between outer and inner layers of each bra cup and extends from a lower to an upper edge of each cup. A support shelf assembly spans across a lower portion of each bra cup and includes a support component located proximate the lower edge of the cups, a non-stretch stabilizer fabric layer spanning between both cups and along a full length of the support component, and a supportive foam layer spanning between both cups and along the support component. The inner, outer, shaping foam, stabilizer fabric, and supportive foam layers span across a center gore that connects the bra cups to form a front panel of the brassiere. The support shelf assembly is molded between the inner layer and the shaping foam layer and is an embedded, integral part of the front panel.

14 Claims, 8 Drawing Sheets

(51) Int. Cl.
*A41C 3/02* (2006.01)
*A41C 3/12* (2006.01)

(58) Field of Classification Search
USPC ..... 450/40
See application file for complete search history.

(56) References Cited

U.S. PATENT DOCUMENTS 2,769,180 A * 11/1956 Tareau ..... A41C 3/124 450/45
2,817,842 A * 12/1957 Block ..... A41C 3/10 450/54
2,834,352 A * 5/1958 Ullian ..... A41C 3/10 450/57
2,844,151 A * 7/1958 Lemons ..... A41C 3/10 450/48
3,196,460 A * 7/1965 Haistead ..... A41C 3/122 2/255
3,202,565 A * 8/1965 Loftin ..... A41C 3/0014 428/175
3,221,747 A * 12/1965 Blair ..... A41C 3/10 450/55
3,266,495 A * 8/1966 Sachs ..... A41C 3/00 428/160
3,642,009 A * 2/1972 Nobbs ..... A41C 3/0021 450/60
3,799,174 A * 3/1974 Howard ..... A41C 3/144 450/40
3,934,593 A * 1/1976 Mellinger ..... A41C 3/065 450/56
4,080,416 A * 3/1978 Howard ..... A41C 5/005 264/257
4,289,137 A * 9/1981 Dell ..... A41C 3/02 2/67
4,325,378 A * 4/1982 Wilkinson ..... A41C 3/02 450/58
4,340,064 A * 7/1982 Vale ..... A41C 3/0057 450/72
4,538,614 A * 9/1985 Henderson ..... A41D 13/0017 2/1
4,945,571 A * 8/1990 Calvert ..... A41D 1/084 2/161.1
4,992,074 A * 2/1991 Diaz ..... A41C 3/065 2/267
5,098,330 A * 3/1992 Greenberg ..... A41C 3/10 450/31
5,221,227 A * 6/1993 Michels ..... A41C 3/0057 2/73
5,527,202 A * 6/1996 Morgan ..... A41C 3/124 450/48
5,660,577 A * 8/1997 Modena ..... A41C 3/00 450/86
5,690,537 A * 11/1997 Kalmus ..... A41C 3/10 2/267
6,000,994 A * 12/1999 Salotto ..... A41C 5/00 2/243.1
6,019,662 A * 2/2000 Fildan ..... A41C 3/124 2/255
6,083,080 A * 7/2000 Lawson ..... A41C 3/10 450/39
6,106,363 A * 8/2000 Werner ..... A41C 3/122 450/41
6,165,045 A * 12/2000 Miller ..... A41C 3/0057 450/1
6,176,761 B1 * 1/2001 Underhill ..... A41C 3/0014 450/1
6,231,423 B1 * 5/2001 Deal ..... A41C 3/10 450/38
6,397,391 B2 * 6/2002 DeMarco ..... A41C 3/0078 2/8.1
6,425,800 B1 * 7/2002 Huang ..... A41C 3/0007 450/41
6,439,959 B1 * 8/2002 Magrone ..... A41C 3/0014 450/41
6,447,365 B1 * 9/2002 Powell ..... A41C 3/122 450/41
6,645,040 B2 * 11/2003 Rabinowicz ..... A41C 3/0014 450/1
6,685,534 B2 * 2/2004 Mitchell ..... A41C 3/0007 450/74
6,688,942 B2 * 2/2004 Holliday ..... A41C 3/0057 450/1
6,811,464 B2 11/2004 Li
6,824,444 B2 * 11/2004 Huang ..... A41C 3/10 450/39
6,846,219 B2 * 1/2005 Moyer ..... A41C 3/00 450/39
6,896,580 B2 * 5/2005 Falla ..... A41C 3/122 2/255
6,966,815 B2 * 11/2005 Weinerth ..... A41C 3/10 450/39
6,986,696 B1 1/2006 Jagaric et al.
6,988,931 B1 1/2006 Martinet et al.
6,997,775 B2 2/2006 Jagaric et al.
7,048,606 B1 5/2006 Martinet et al.
7,052,360 B2 5/2006 Lau
7,131,888 B2 * 11/2006 Hsu ..... A41C 3/0007 450/39
7,241,199 B2 * 7/2007 Huang ..... A41C 3/0007 450/39
7,309,276 B2 * 12/2007 Legaspi ..... A41C 3/10 450/41
7,311,583 B2 12/2007 Jagaric et al.
7,390,239 B1 * 6/2008 Huang ..... A41C 3/0007 450/39
7,407,427 B2 * 8/2008 Liu ..... A41C 3/00 450/39
7,442,110 B2 * 10/2008 Gaudet ..... A41C 3/0057 450/39
7,458,877 B2 * 12/2008 Yu ..... A41C 3/12 450/39
7,563,152 B2 * 7/2009 Liu ..... A41C 3/0014 450/39
7,604,526 B2 10/2009 Liu
7,690,965 B2 * 4/2010 Falla ..... A41C 3/0007 450/39
RE41,654 E * 9/2010 Struble ..... A41C 3/08 2/106
7,833,082 B2 * 11/2010 Bugada ..... A41C 3/0014 450/39
7,862,401 B2 * 1/2011 Watrin ..... A41C 3/0014 450/39
7,871,305 B2 * 1/2011 Cohen ..... A41C 3/0028 450/54
8,113,909 B2 2/2012 Liu
8,167,678 B2 * 5/2012 Castellano ..... A41C 3/144 450/39
8,419,502 B2 * 4/2013 Liu ..... A41C 3/144 450/39
8,419,503 B2 * 4/2013 Zhang ..... A41C 3/122 450/39
8,585,459 B2 11/2013 Martinet et al.
8,747,184 B2 * 6/2014 Liu ..... A41C 3/0007 450/41
8,747,185 B1 * 6/2014 Evans, Sr. ..... A41C 3/124 450/41
8,864,549 B2 * 10/2014 McKeen ..... A41C 3/0021 450/51
9,198,468 B2 12/2015 McNeeley et al.
9,210,955 B2 * 12/2015 Dandapure ..... A41C 3/00
9,226,530 B1 * 1/2016 Silverman ..... A41C 3/0057
9,237,772 B2 1/2016 McKeen
9,241,514 B2 * 1/2016 Shearer ..... A41C 3/0057
9,392,822 B2 7/2016 McKeen
9,402,424 B2 * 8/2016 Roy ..... A41C 5/005
9,480,287 B2 * 11/2016 Black ..... A41C 3/0057
9,578,901 B2 * 2/2017 Randall ..... A41C 3/0057
9,622,516 B2 * 4/2017 Lau ..... A41C 3/0057
10,231,492 B1 * 3/2019 Bastug ..... A41C 3/0007

(56) References Cited

U.S. PATENT DOCUMENTS 10,271,585 B2 * 4/2019 McKeen ..... A41C 3/0021
2001/0019933 A1 * 9/2001 Wagner ..... A41C 3/0057 450/37
2003/0082994 A1 * 5/2003 Mitchell ..... A41C 3/0007 450/74
2003/0092355 A1 * 5/2003 Rabinowicz ..... A41C 3/0014 450/1
2003/0232571 A1 * 12/2003 Weinerth ..... A41C 3/10 450/41
2005/0164602 A1 * 7/2005 Armstrong ..... A41C 3/0057 450/57
2006/0046614 A1 * 3/2006 Hsu ..... A41C 3/0007 450/1
2006/0105674 A1 * 5/2006 Lau ..... A41C 3/0014 450/39
2006/0240743 A1 * 10/2006 Mitchell ..... A41C 3/0014 450/1
2007/0155283 A1 * 7/2007 McQueer ..... A41C 3/0057 450/39
2008/0090491 A1 * 4/2008 Liu ..... A41C 3/0014 450/39
2008/0153388 A1 * 6/2008 Liu ..... A41C 3/00 450/39
2008/0305714 A1 * 12/2008 Sobah-Wilhelm ... A41C 3/0028 450/38
2009/0098803 A1 * 4/2009 Reinisch ..... A41C 3/0057 450/39
2009/0197509 A1 * 8/2009 Fildan ..... A41C 3/142 450/93
2009/0233523 A1 * 9/2009 Pardo ..... A41C 3/10 450/39
2009/0233524 A1 * 9/2009 Cohen ..... A41C 3/0028 450/56
2009/0247047 A1 * 10/2009 Avalos-Dessner ..... A41C 3/10 450/52
2010/0015886 A1 * 1/2010 Waitz ..... A41C 3/10 450/39
2010/0056022 A1 * 3/2010 Liu ..... A41C 3/10 450/39
2010/0317256 A1 * 12/2010 Zhang ..... A41C 5/005 450/38
2011/0104985 A1 * 5/2011 Linder ..... A41C 3/0057 450/58
2011/0287691 A1 * 11/2011 Hu ..... A41C 3/10 450/56
2011/0300774 A1 * 12/2011 Smith ..... A41C 5/00 450/41
2012/0094575 A1 * 4/2012 Sokolowski ..... A41C 3/0014 450/92
2012/0122370 A1 * 5/2012 Heath ..... A41C 3/0057 450/80
2012/0171929 A1 * 7/2012 Cheung ..... A41C 3/0007 450/52
2012/0184180 A1 * 7/2012 Hu ..... A41C 3/10 450/55
2012/0184181 A1 * 7/2012 Liu ..... A41C 3/0007 450/60
2013/0165017 A1 * 6/2013 Liu ..... A41C 3/146 450/38
2014/0213145 A1 * 7/2014 McKeen ..... A41C 3/0021 450/59
2014/0256221 A1 * 9/2014 Liang ..... A41C 3/12 450/41
2014/0302746 A1 * 10/2014 Warren ..... A41C 3/128 450/39
2014/0329438 A1 * 11/2014 Horii ..... A41C 3/142 450/41
2015/0111466 A1 * 4/2015 Martinet ..... A41C 3/065 450/41
2015/0264982 A1 * 9/2015 Randall ..... A41C 3/0057 450/52
2016/0044971 A1 * 2/2016 Randall ..... A41C 3/142 450/39
2016/0058075 A1 3/2016 Dandapure et al.
2016/0309795 A1 * 10/2016 Shearer ..... A41C 3/0057
2016/0309797 A1 10/2016 McKeen
2017/0095010 A1 * 4/2017 Fildan ..... A41C 3/0007
2017/0188638 A1 * 7/2017 Liu ..... A41C 3/0064
2017/0226691 A1 * 8/2017 Farmer ..... A41B 17/00
2017/0318867 A1 * 11/2017 Wiesman ..... A41C 3/0064
2018/0055097 A1 * 3/2018 Delaney ..... A41B 1/08
2018/0242653 A1 * 8/2018 Brandt ..... A41C 3/0057
2018/0249767 A1 * 9/2018 Begriche ..... H05K 1/0283

FOREIGN PATENT DOCUMENTS

CN 202077593 U 12/2011
CN 103269610 A 8/2013
CN 104544594 A 4/2015
CN 102215707 B 4/2016
CN 105473015 A 4/2016
CN 205624537 U 10/2016
CN 106136350 A 11/2016
EP 1872674 A1 1/2008
EP 2153739 A1 2/2010
EP 2695535 A1 2/2014
WO 2003033796 A1 4/2003
WO 2008020327 A2 2/2008

OTHER PUBLICATIONS

Search Report issued in corresponding application CN Application No. 201710346950.3, dated Oct. 10, 2018.
Under Armour, Armour High Bra, website, last accessed Mar. 31, 2017, available at https://www.underarmour.com/enus/womensuaarmourhighbra/pid1259953 (admitted prior art).
Reebok, Hero Racer Bra 2.0, website, last accessed Mar. 31, 2017, available at http://www.reebok.com/us/reebokheroracerbra2.0/AJ2562.html (admitted prior art).
Lululemon, Black Go Steady Bra, website, last accessed Mar. 31, 2017, available at https://www.amazon.com/LululemonBlackGoSteadyBra/dp/B019JCI2C2 (admitted prior art).

* cited by examiner

BRASSIERE AND FRONT PANEL FOR BRASSIERE

CROSS-REFERENCE TO RELATED APPLICATION

This application claims the benefit of and priority to U.S. Provisional Application Ser. No. 62/337,027, filed on May 16, 2016, which is hereby incorporated by reference herein.

FIELD

The present application relates to brassieres, and applies to both sports bras and lingerie.

BACKGROUND

U.S. Pat. No. 8,747,184 discloses a support structure for placement in a lower periphery of a breast cup for a brassiere. The support structure includes a support component shaped to follow the curve of at least the underside of a wearer's breast. The support component includes a first region formed by a first polymer material and a second region formed by a second polymer material, wherein the first polymer material is harder than the second polymer.

Chinese Utility Model Publication No. CN205624537U discloses a cup for a bra comprising a foam-fabric inner layer for contact with the skin, characterized in that an outer sandwich cloth layer is provided on the side of the foam-fabric inner layer away from the skin. An inner steel ring is sandwiched between the inner edges of the foam-fabric inner layer and the outer sandwich cloth layer. The outer sandwich cloth layer has at least two fabric layers and a support comprising hot melt yarn between the two fabric layers.

SUMMARY

This Summary is provided to introduce a selection of concepts that are further described below in the Detailed Description. This Summary is not intended to identify key or essential features of potentially claimed subject matter, nor is it intended to be used as an aid in limiting the scope of potentially claimed subject matter.

According to one example of the present disclosure, a front panel for a brassiere includes a pair of bra cups, each bra cup in the pair of bra cups configured to hold one of a wearer's breasts. An inner layer of each bra cup is configured to contact the wearer's skin and an outer layer of each bra cup opposes the inner layer. A support shelf assembly spans across at least a lower portion of each bra cup. The support shelf assembly comprises a plastic support component located proximate a lower edge of each respective bra cup, a non-stretch stabilizer fabric layer spanning between both bra cups and along a full length of the support component, and a first supportive foam layer spanning between both bra cups and along the support component. The support shelf assembly is molded between the inner and outer layers of each bra cup such that the support shelf assembly is an embedded, integral part of the front panel.

According to another example of the present disclosure, a brassiere includes a pair of bra cups, each bra cup in the pair of bra cups configured to hold one of a wearer's breasts. An inner layer of each bra cup is configured to contact the wearer's skin and an outer layer of each bra cup opposes the inner layer. A shaping foam layer is sandwiched between the outer layer and the inner layer of each bra cup. The shaping foam layer extends from a lower edge of each bra cup to an upper edge of each bra cup. A support shelf assembly spans across at least a lower portion of each bra cup. The support shelf assembly comprises a support component located proximate the lower edge of each respective bra cup, a non-stretch stabilizer fabric layer spanning between both bra cups and along a full length of the support component, and a first supportive foam layer spanning between both bra cups and along the support component. The inner layer, outer layer, and shaping foam layer of each bra cup and the stabilizer fabric layer and first supportive foam layer of the support shelf assembly span across a center gore that connects the bra cups to form a front panel of the brassiere. The support shelf assembly is molded between the inner layer and the shaping foam layer of each bra cup such that the support shelf assembly is an embedded, integral part of the front panel.

BRIEF DESCRIPTION OF THE DRAWINGS

Examples of brassieres, front panels for brassieres, and methods for manufacturing brassieres are described with reference to the following figures. These same numbers are used throughout the figures to reference like features and like components.

DETAILED DESCRIPTION

A brassiere (bra) pad construction for incorporation into a bra cup of a sports bra or a lingerie-type bra includes an outer layer comprising a spacer fabric and an inner layer comprising a different type of fabric. One or more layers of foam are molded and/or laminated to an inner face of the spacer fabric. A plastic support component is molded between the one or more layers of foam and/or the spacer fabric. The support component is part of a support shelf assembly that extends along a lower edge of a front panel of the bra. Various examples will be described herein below.

Figure 1:
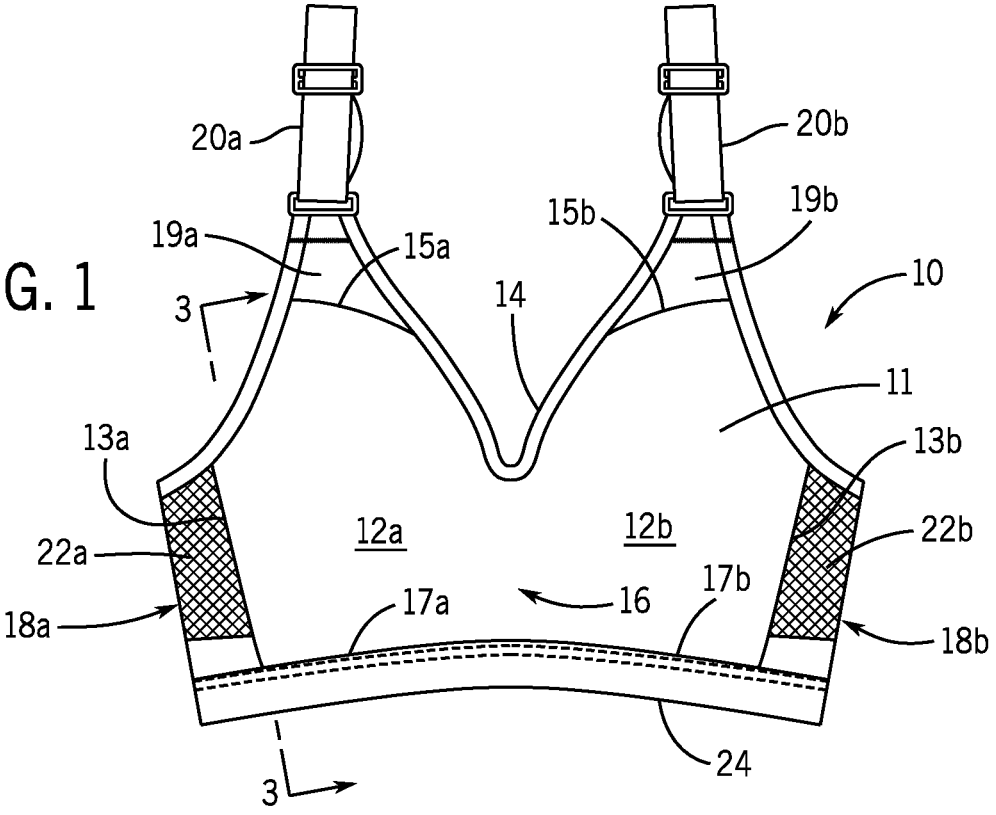
FIG. 1 illustrates one example of a front half of a sports bra according to the present disclosure.

FIG. 1 illustrates a front portion of a sports bra 10 according to the present disclosure. The sports bra 10 includes a front panel 11 having a pair of bra cups 12*a*, 12*b* and a plunging neckline 14. Each bra cup 12*a*, 12*b* in the pair of bra cups is configured to hold one of a wearer's breasts (see FIGS. 10 and 11). The neckline 14 plunges to a central connection area known as a center gore 16, which connects the bra cups 12*a*, 12*b*. Laterally outer edges 13*a*, 13*b* of each of the bra cups 12*a*, 12*b* are connected to underarm areas

Figure 2:
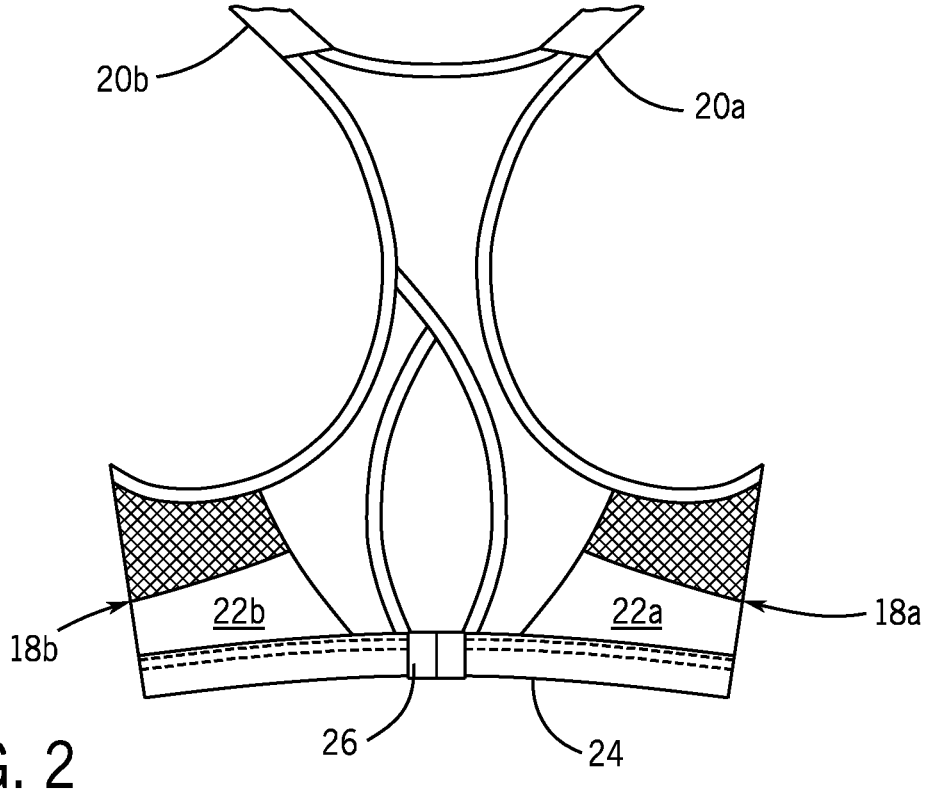
FIG. 2 illustrates one example of a back half of the sports bra of FIG. 1.

18*a*, 18*b*. Upper edges 15*a*, 15*b* of the bra cups 12*a*, 12*b* are coupled to straps 20*a*, 20*b*, for example by fabric pieces 19*a*, 19*b*. In another example, the straps 20*a*, 20*b* can be directly connected to the upper edges 15*a*, 15*b* of the bra cups 12*a*, 12*b*. The straps 20*a*, 20*b* continue to the back portion of the sports bra 10, which is shown in FIG. 2, and there connect to wings 22*a*, 22*b*, which make up the underarm areas 18*a*, 18*b*, respectively. As shown, the straps 20*a*, 20*b* connect to one another in a racer back shape; however, a T-shape or another shape could be provided. In an alternative embodiment, the straps 20*a*, 20*b* continue straight down to the wings 22*a*, 22*b*. The straps 20*a*, 20*b* may be made of an elastic material. As shown herein, the straps 20*a*, 20*b* are adjustable; however, the length of the straps 20*a*, 20*b* could alternatively be fixed.

A torso band 24 runs around the lower edge of the sports bra 10, is coupled to lower edges 17*a*, 17*b* of the bra cups 12*a*, 12*b*, and includes a clasp or connector 26 in the back of the bra 10, where the wings 22*a*, 22*b* of the sports bra 10 can be partially disconnected from and reconnected to one another in order to provide a desired fit around a wearer's torso. The connector 26 can be Velcro, hook and eye, snaps, or any other type of connector known to those having ordinary skill in the art. The torso band 24 can be made of an elastic material to provide stretch as the wearer moves or pulls the sports bra 10 over her head. The torso band 24 can be used to provide a finished edge for the bottom of the bra cups 12*a*, 12*b* and wings 22*a*, 22*b*, such as if the torso band 24 is folded in half so as to overlap the bottom edge of the sports bra 10. Alternatively, the elastic torso band can be connected to only an outer or an inner face of the bottom edge of the sports bra 10.

Note that the extent of the front panel 11 is also defined by the upper edges 15*a*, 15*b* of the bra cups 12*a*, 12*b*, the outer edges 13*a*, 13*b* of the bra cups 12*a*, 12*b*, and the lower edges 17*a*, 17*b* of the bra cups 12*a*, 12*b*. As will be described herein below, the front panel can be formed of layers of single, continuous sheets of fabric and foam, some of which have the same extent as the outline of the front panel 11 shown herein. This creates a strong, supportive front panel 11 for the sports bra 10, which provides the necessary support and motion control for the wearer's breasts during exercise, as well as makes the front panel 11 easy to manufacture.

Figure 3:
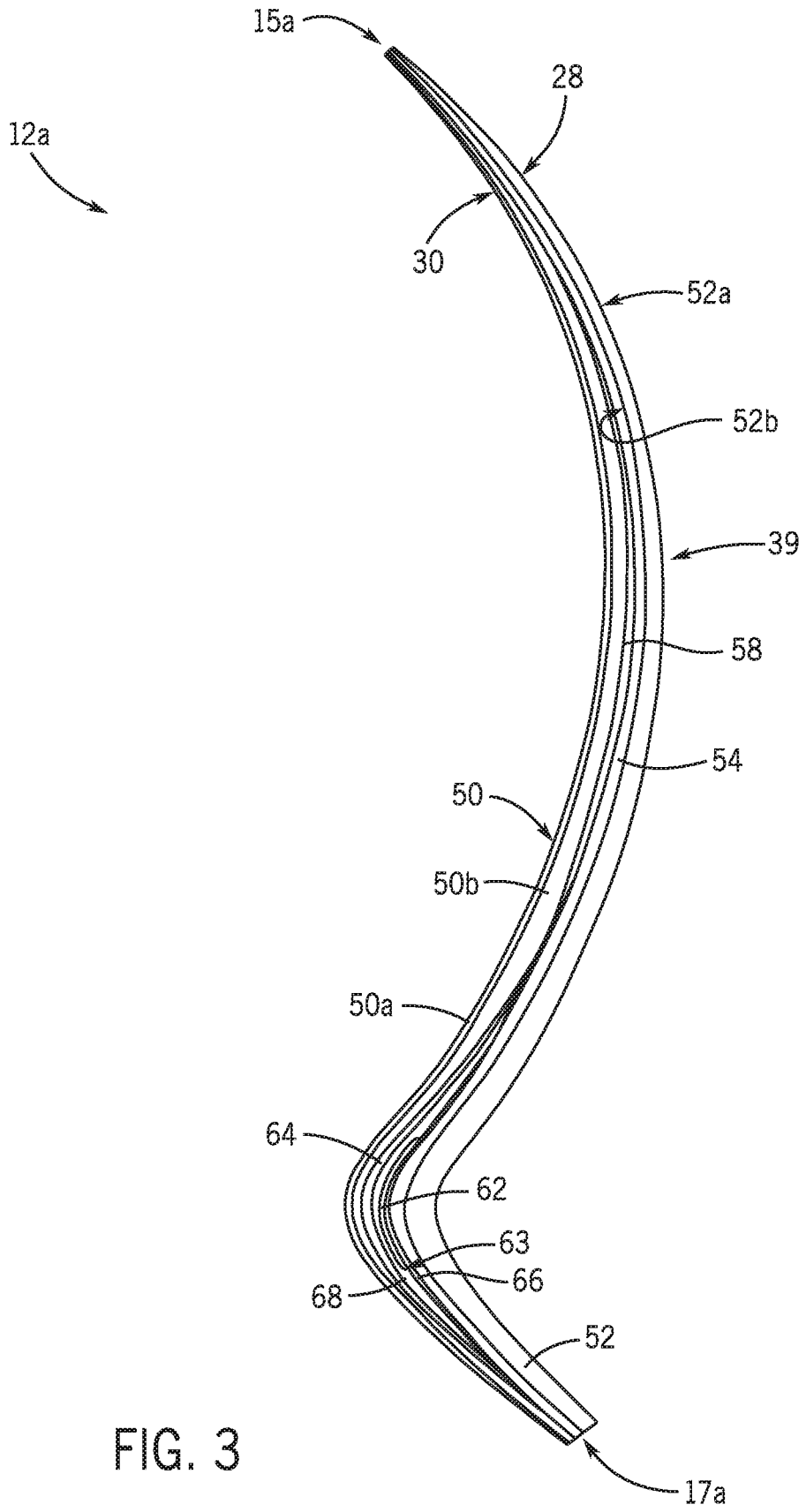
FIGS. 3-7 illustrate several examples of cross sections of a bra cup for use in a bra according to the present disclosure.

FIG. 3 shows a cross section through the bra cup 12*a* of FIG. 1, taken along the line III-III. Although this cross section is taken close to the underarm area 18*a* of the sports bra 10, this cross section is essentially the same across the entire bra cup 12*a*, except for relative dimensional changes in the thickness, height, and curvature of the bra cup 12*a*. Additionally, it should be noted that the cross section through the bra cup 12*b* is identical, although it will not be described separately herein. In fact, the bra cup 12*b* is a mirror image of the bra cup 12*a*, and therefore any description of the bra cup 12*a* applies in kind to the bra cup 12*b*. FIG. 3 shows how the bra cup 12*a* has two sides. Specifically, an outer side 28 faces away from the wearer when the sports bra 10 is being worn. An inner side 30 faces the wearer and touches the wearer's skin when the sports bra 10 is being worn.

Starting at the inner side 30, the bra cup 12*a* includes an inner layer 50 configured to contact the wearer's skin. In the present example, the inner layer 50 of the bra cup 12*a* comprises liner fabric 50*a* laminated to foam 50*b*, and the liner fabric 50*a* is configured to contact the wearer's skin. Because the inner face of the liner fabric 50*a* is in direct contact with the wearer's skin, it is therefore a soft, comfortable fabric, such as polyester or some type of blend. In one example, the liner fabric 50*a* is made of 100% polyester weft knit interlock and has a weight of 95 g/m$^2$ having 48 courses per inch and 52 wales per inch (32 gauge). The outer face of the liner fabric 50*a* is laminated to foam 50*b* prior to assembly with the remainder of the bra cup 12*a*. The foam 50*b* is coextensive with the liner fabric 50*a*. In one example, prior to molding the bra cup 12*a*, the foam 50*b* has a uniform thickness along the height of the bra cup 12*a* and is about 2 mm thick. The foam 50*b* can be medium density stretch foam, and in one example has a density of 45 kg/m$^3$.

Figure 10:
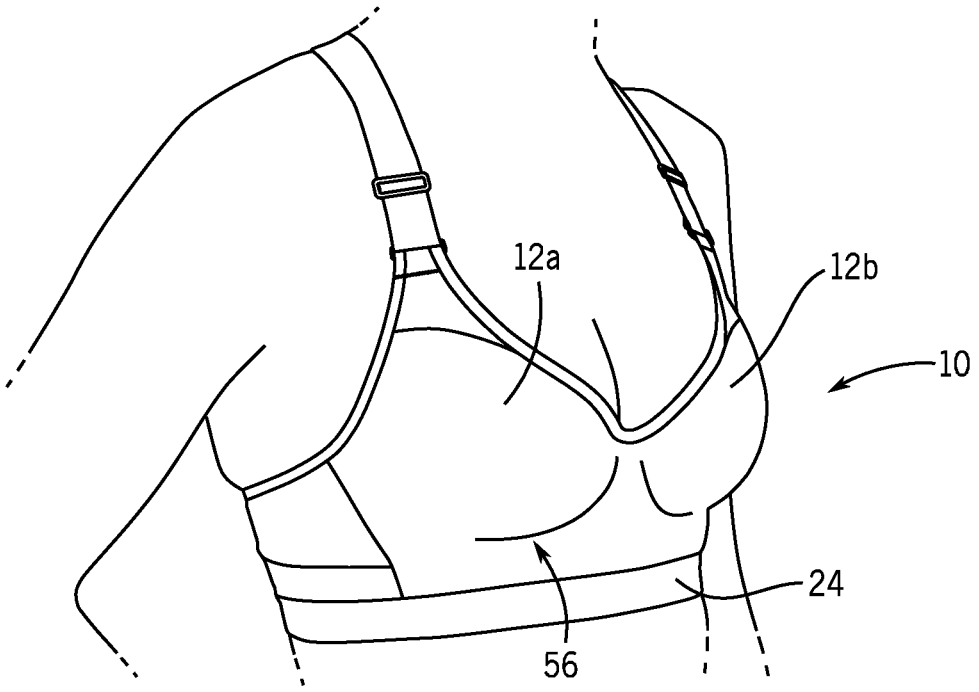
FIG. 10 illustrates a perspective view of a sports bra according to the present disclosure as worn by a wearer.

Turning to the outer side 28, the bra cup 12*a* also includes an outer layer 52 opposing the inner layer 50. In the example shown herein, the outer layer 52 of the bra cup 12*a* comprises a spacer fabric. As is known, spacer fabrics are three-dimensional fabrics that have an inner face layer, an outer face layer, and a pile/connecting layer. Here, the outer face layer is shown at 52*a*, and is left exposed rather than covered with another layer of fabric. The outer face layer 52*a* can be a solid color (FIG. 11) or can be printed with a pattern (FIG. 10). The pattern can be printed directly onto the outer face layer 52*a* of the spacer fabric outer layer 52 after the spacer fabric is knit. In this example, the pile/connecting layer is not died or printed, but only the outer face layer 52*a* is printed. The layers of the spacer fabric outer layer 52 can be knitted with polyethylene terephthalate (PET), polyurethane (PU), and/or polyester fibers, among other types of fibers that provide stretch and breathability to the spacer fabric outer layer 52.

The opposite, inner face layer 52*b* of the spacer fabric outer layer 52 is directly molded to a shaping foam layer 54. The shaping foam layer 54 is sandwiched between the outer layer 52 and the inner layer 50 of the bra cup 12*a* and the shaping foam layer 54 extends from the lower edge 17*a* of the bra cup 12*a* to the upper edge 15*a* of the bra cup 12*a*. The shaping foam layer 54 can be medium density stretch foam, and in one example has a density of 45 kg/m$^3$. The thickness of the shaping foam layer 54, before it is molded as part of the bra cup 12*a*, ranges from about 1 mm to about 5 mm, depending on what part of the bra cup 12*a* it forms. In one example, the shaping foam layer 54 is 2 mm thick before being molded. This uniform thickness may continue up the bra cup 12*a* to a location approximately halfway between an apex 39 of the bra cup 12*a* and the upper edge 15*a*. Thereafter, the thickness of the shaping foam layer 54 tapers off drastically toward the upper edge 15*a* of the bra cup 12*a* to provide a smooth neckline transition.

It can be seen that the thickness of the liner fabric 50*a* is roughly the same along the entire height of the bra cup 12*a*, while the foam 50*b* of the inner layer 50, the shaping foam layer 54, and the spacer fabric outer layer 52 are relatively thicker in some areas as opposed to others. For instance, near the neckline 14 at the upper edge 15*a* and near the torso band 24 at the lower edge 17*a*, the spacer fabric outer layer 52 and the foam layers 50*b*, 54 become thinner. This relative change in thickness can be achieved by molding of the cup, for example, if the male and female halves of the mold are closer to one another at the upper and lower edges 15*a*, 17*a* than in the area of the bra cup 12*a* configured to be situated immediately under the wearer's breasts, in the creases between her breasts and her torso. Thus, both the way the bra cup 12*a* is molded and the pre-molding thickness differential of a given layer can influence the final thickness of that given layer.

In addition to having foam layers 50*a*, 54 that are of different thicknesses in different areas before and/or after being molded, the bra cup 12*a* can also include a covering foam layer 58 sandwiched between the shaping foam layer 54 and the inner layer 50. A separate piece of foam can be provided for each bra cup 12*a*, 12*b* as the covering foam layer 58. (See FIG. 8, pieces 58*a*, 58*b*. ) The covering foam layer(s) 58 is/are centered at the apex 39 of each respective bra cup 12*a*, 12*b*. The covering foam layer 58 can be relatively high density foam in comparison to the other foam layers so as to provide coverage and prevent nipple show-though. In another example, the covering foam layer 58 includes a layer of 100% spandex laminated to a layer of foam. Because the spacer fabric outer layer 52 and the shaping foam layer 54 are provided up the entire height of the bra cup 12*a*, these layers 52, 54 work together with the covering foam layer 58, which can be as thick as 4 mm, to provide modesty to the bra cup and further prevent nipple show-through.

Figure 8:
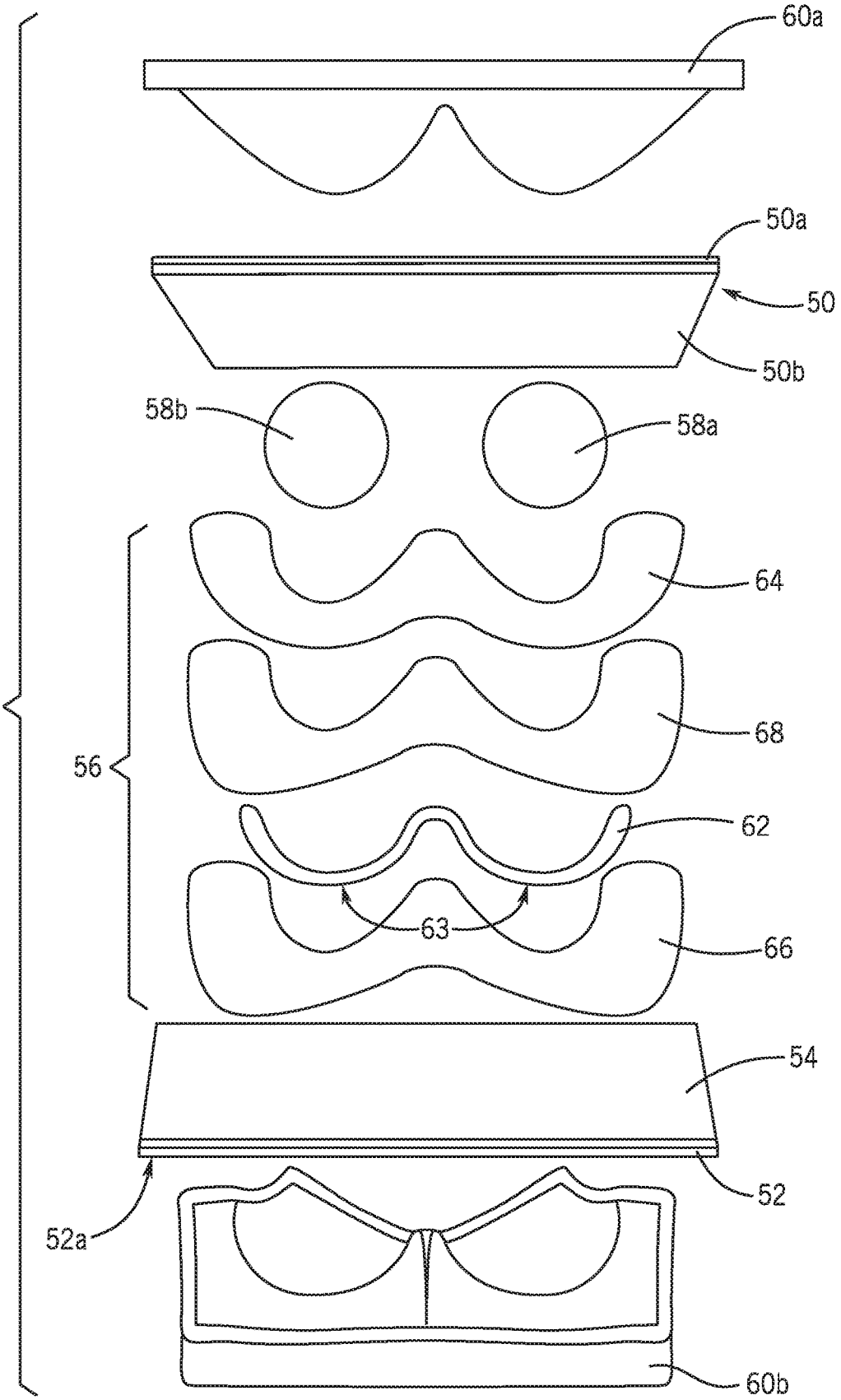
FIG. 8 illustrates the layers of the bra cup of FIG. 3 as they would be placed in a mold for molding the cups of the sports bra.

Each of the layers of the bra cup 12*a* described herein above is also shown in FIG. 8, which shows the layers that make up both bra cups 12*a* and 12*b* as they would be placed in a mold having a male half 60*a* and a female half 60*b*. The layers making up a support shelf assembly 56, configured to be situated immediately under the wearer's breasts, are also shown in FIG. 8. Referring now to both FIGS. 3 and 8, the support shelf assembly 56 spans across at least a lower portion of each bra cup 12*a*, 12*b*, for example, in an area located below the apexes 39 and above (or extending to) the lower edges 17*a*, 17*b* of the bra cups 12*a*, 12*b*. The support shelf assembly 56 comprises a plastic support component 62 located proximate the lower edge 17*a*, 17*b* of each respective bra cup 12*a*, 12*b*. In this example, the support component 62 is an undulating, W-shaped molded body configured to support an underside of the wearer's breasts. In cross-section, the support component 62 has a crescent shape that mimics the crease under the wearer's breasts. A non-stretch stabilizer fabric layer 64 spans between both bra cups 12*a*, 12*b* and along the support component 62. A first supportive foam layer 66 also spans between both bra cups 12*a*, 12*b* and along the support component 62. The support shelf assembly 56 further comprises a second supportive foam layer 68 spanning between both bra cups 12*a*, 12*b* and along the support component 62. The second supportive foam layer 68 is located on an opposite side (here, an inner side) of the support component 62 than the first supportive foam layer 66.

In the present embodiment, the stabilizer fabric layer 64, the first supportive foam layer 66, and the second supportive foam layer 68 of the support shelf assembly 56 all have an undulating shape that mimics a curvature of an underside of the wearer's breasts. The stabilizer fabric layer 64 extends along a full length of the support component 62. Note that in the present embodiment, the stabilizer fabric layer 64, the first supportive foam layer 66, and the second supportive foam layer 68 of the support shelf assembly 56 are each single, continuous layers of material spanning both of the bra cups 12*a*, 12*b* and extending along the full length of the support component 62, which arrangement provides structural integrity to the supportive portion of the bra cups 12*a*, 12*b*. Note too that the inner and outer layers 50, 52 and the shaping foam layer 54 of each bra cup 12*a*, 12*b* and the first supportive foam layer 66, the second supportive foam layer 68, and the stabilizer fabric layer 64 of the support shelf assembly 56 all extend below a lower edge 63 of the support component 62. The shape, length, and height of these layers provide extra support in the area of the support shelf assembly 56, beyond that which a bendable, moldable plastic support component 62 could provide on its own. This is especially so given that the support shelf assembly 56 is molded between the inner and outer layers 50, 52 of each bra cup 12*a*, 12*b* such that the support shelf assembly 56 is an embedded, integral part of the front panel 11. This molding/embedding process will be described further herein below.

In the present example, referring also to FIGS. 1 and 10, the inner and outer layers 50, 52 and the shaping foam layer 54 of each bra cup 12*a*, 12*b* and at least the first supportive foam layer 66 and the stabilizer fabric layer 64 of the support shelf assembly 56 all extend to the lower edge 17*a*, 17*b* of each bra cup 12*a*, 12*b* and are coupled to the elastic torso band 24. This provides stability and relative stiffness not only in the immediate area of the support component 62, but also beneath the support component 62, because the support shelf assembly 56 extends below the wearer's breasts and lays flat against her torso (see FIG. 10). Such relative stiffness, when compared to the remainder of the bra cups 12*a*, 12*b*, prevents the portion of the bra cups 12*a*, 12*b* below the support component 62 from folding over due to the weight of the wearer's breasts and/or movement thereof during exercise. Additionally, such an arrangement allows the layers 64, 66, 68 of the support shelf assembly 56 to provide additional support to that already provided by the support component 62 without adding bulk or weight near the tops of the bra cups 12*a*, 12*b*.

The first supportive foam layer 66 is provided on the outer face of the support component 62 and provides extra support thereto. In one example, the first supportive foam layer 66 is about 3 mm thick prior to molding and has a density of 45 kg/m$^3$. In another example, the first supportive foam layer 66 is not provided, and instead the shaping foam layer 54 is thicker in the area along the support component 62.

The second supportive foam layer 68 provides extra padding between the support component 62 and the wearer's chest, in order to provide comfort to the wearer. The second supportive foam layer 68 also provides extra support to the underside of the wearer's breasts. In another example, the foam 50*b* of the inner layer 50 is thicker near where it is molded to the support component 62 via the stabilizer fabric layer 64, and the bra cup 12*a* does not include a second supportive foam layer 68. However, if a second supportive foam layer 68 is provided, this second supportive foam layer 68 can have the same or a different density than the foam 50*b* of the inner layer 50, and the padding and support of the support shelf assembly 56 can thereby be controlled. In one example, the second supportive foam layer 68 is about 5 mm thick prior to molding and has a density of 45 kg/m$^3$.

The stabilizer fabric layer 64 is provided between the second supportive foam layer 68 and the foam 50*b* of the inner layer 50. The stabilizer fabric layer 64 provides the support shelf assembly 56 with extra support and creates a more stable bond between the foam 50*b* and the foam 68. In another example, the stabilizer fabric layer 64 and the second supportive foam layer 68 are swapped, such that the stabilizer fabric layer 64 is immediately next to the support component 62. The stabilizer fabric layer 64 is made of non-stretch fabric, which provides support to the wearer's breasts. In one example, the stabilizer fabric layer 64 is made of 100% polyester weft knit interlock and has a weight of 100 g/m$^2$ having 48 courses per inch and 48 wales per inch (28 gauge). In another example, the stabilizer fabric layer 64 is made of 100% polyester weft knit interlock and has a weight of 95 g/m$^2$ having 48 courses per inch and 52 wales per inch (32 gauge).

When constructing the bra cups 12*a*, 12*b* of the present disclosure, the spacer fabric outer layer 52 may be pre-molded into the desired cup shapes. Prior to such pre-molding, the spacer fabric outer layer 52 may be laminated to the shaping foam layer 54 using, for example, one or all of heat, pressure, and spray adhesive. The support component 62 may also be pre-molded into the undulating W-shaped body. The liner fabric 50*a* and the foam 50*b* of the inner layer 50 are also pre-laminated together. Next, referring to FIG. 8, the pre-molded spacer fabric outer layer 52, the shaping foam layer 54, the first supportive foam layer 66, the pre-molded support component 62, the second supportive foam layer 68, the stabilizer fabric layer 64, the covering foam layer pieces 58*a*, 58*b*, and the laminated inner layer 50 are placed together in the mold 60*a*, 60*b*. The layers are molded to the desired shape while being heated to a desired temperature. During the molding process, the plastic support component 62 is directly fused to the first and second supportive foam layers 66, 68, or to the stabilizer fabric layer 64 if no second supportive foam layer 68 is provided. Thus, the support component 62 does not shift within the cups, but rather is embedded in place in the cups. In effect, the support component 62 acts as a relatively stiffer area of the cups, and poke through, breakage, or other negative occurrences associated with normal underwires are thereby avoided because the support component 62 is an integral part of the molded bra cups 12*a*, 12*b*. Because the support component 62 is molded directly to cushioning, padded materials, this provides extra comfort for the wearer.

In the example shown in FIG. 8, the mold 60*a*, 60*b* is shaped to form both of the bra cups 12*a*, 12*b* and the center gore 16 at once, thereby forming the entire front panel 11 of the bra 10. After the bra cups 12*a*, 12*b* are molded, other fabric layers can be stitched to the molded bra cups 12*a*, 12*b*, for example after being molded separately themselves. Next, the molded front panel 11 is cut to size and provided with trim, which can be sewn or laminated around the edges 13*a*, 13*b*, 15*a*, 15*b*, 17*a*, 17*b* of the bra cups 12*a*, 12*b*. As described herein above, the torso band 24 can be sewn and/or laminated to the lower edges 17*a*, 17*b* of the bra cups 12*a*, 12*b* to provide a finished edge. The wings 22*a*, 22*b* can be later sewn or otherwise connected to the outer edges 13*a*, 13*b* of the bra cups 12*a*, 12*b*. The fabric pieces 19*a*, 19*b* can be used to connect the upper edges 15*a*, 15*b* to the straps 20*a*, 20*b*. In another embodiment, the front panel 11 can be cut apart at the center gore 16 to form two separate bra cups 12*a*, 12*b*, which can then be re-connected with a zipper or other closure, as will be described further herein below with respect to FIG. 11.

Figure 4:
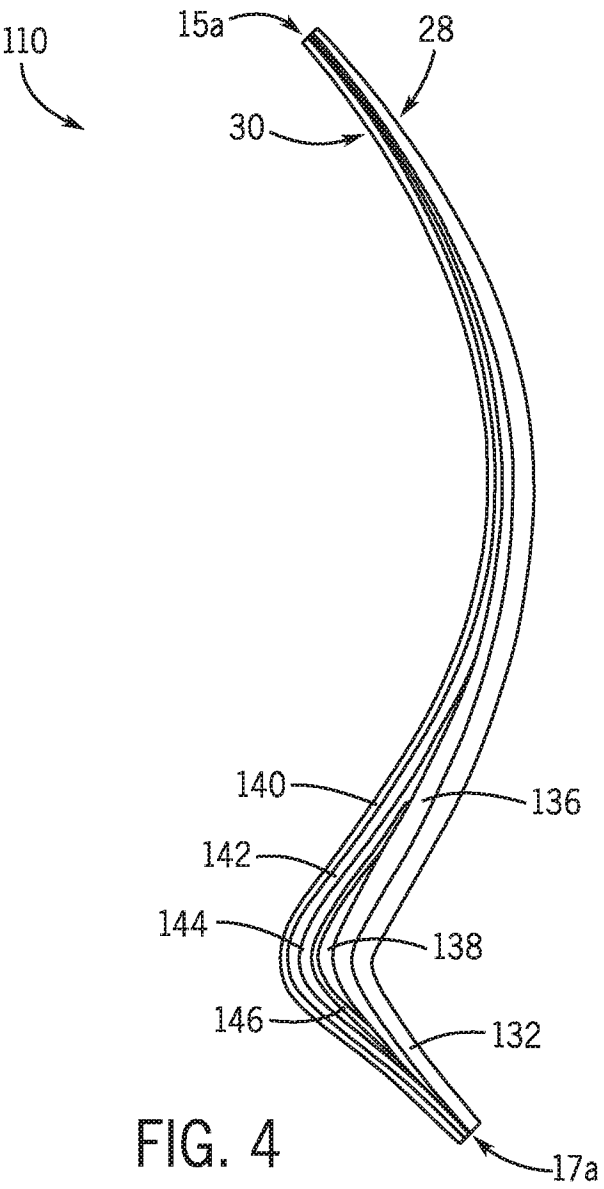

FIG. 4 shows an alternative example of a cross section of a bra cup 110 according to the present disclosure. Starting at the outer side 28, the bra cup 110 includes a outer layer comprising a spacer fabric 132. The inner face layer of the spacer fabric 132 is directly molded to a shaping foam layer 136. Similar to the first embodiment, the shaping foam layer 136 reaches to the same height as the spacer fabric 132, but its thickness tapers off drastically toward the upper edge 15*a* of the bra cup 110. The thickness of the shaping foam layer 136 also tapers off dramatically toward the lower edge 17*a* of the bra cup 110, so as not to add bulk or weight in this area. An inner face of the shaping foam layer 136 can be directly molded to a plastic support component 138. The thickness of the shaping foam layer 136, even before it is molded as part of the cup 120, ranges from about 8 mm to about 1 mm, depending on what part of the bra cup 110 it forms. In one example, the shaping foam layer 136 is 8 mm thick where it contacts the support component 138 in order to provide extra support in this area. The inner side 30 of the bra cup 110 includes an inner layer comprising a liner fabric 140 laminated to foam 142. In one example, prior to molding the bra cup 110, the foam 142 has a uniform thickness along the height of the bra cup 110 and is about 1 mm thick. Again, similar to the first embodiment, the thickness of the liner fabric 140 is roughly the same along the entire height of the cup 120, while the foams 136, 142 and the spacer fabric 132 are relatively thicker in some areas as opposed to others. For instance, near the neckline at the upper edge 15*a*, the spacer fabric 132 and the foam layers 136, 142 become thinner. A supportive foam layer 144 is sandwiched between the foam 142 and the support component 138. The supportive foam layer 144 provides extra padding and extra support to the underside of the wearer's breasts. A stabilizer fabric layer 146 is provided between the supportive foam layer 144 and the support component 138. The stabilizer fabric layer 146 provides the support component 138 with extra support and with a more stable bond to the supportive foam layer 144.

Figure 9:
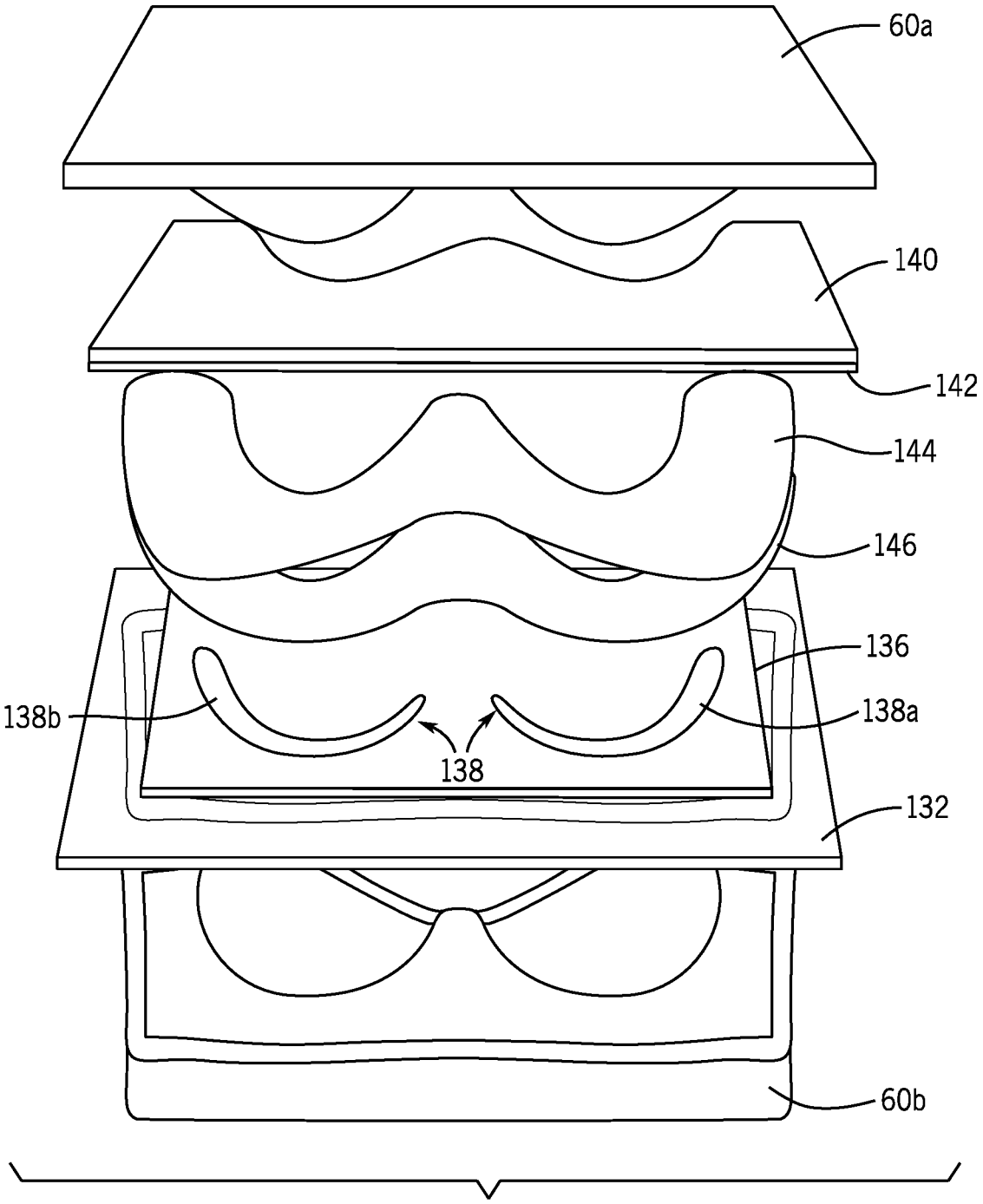
FIG. 9 illustrates the layers of the bra cup of FIG. 4 as they would be placed in a mold for molding the cups of the sports bra.

FIG. 9 shows the layers of the second embodiment of the bra cup 110 as they would be placed in between the halves 60*a*, 60*b* of a mold. Note that in this example, the support component 138 includes two separate halves 138*a*, 138*b*. More specifically, the support component 138 comprises two lateral halves 138*a*, 138*b*, each half of the support component being a U-shaped molded body configured to support an underside of a respective one of the wearer's breasts. This type of support component 138 might be desirable if the bra cups are to be used in a front-close bra such as a bra with a zipper up the front connecting the two bra cups at the center gore 16. (See FIG. 11.) Note that together, the two support components 138*a*, 138*b*, the stabilizer fabric layer 146, and the supportive foam layer 144 make up a support shelf assembly.

Figure 5:
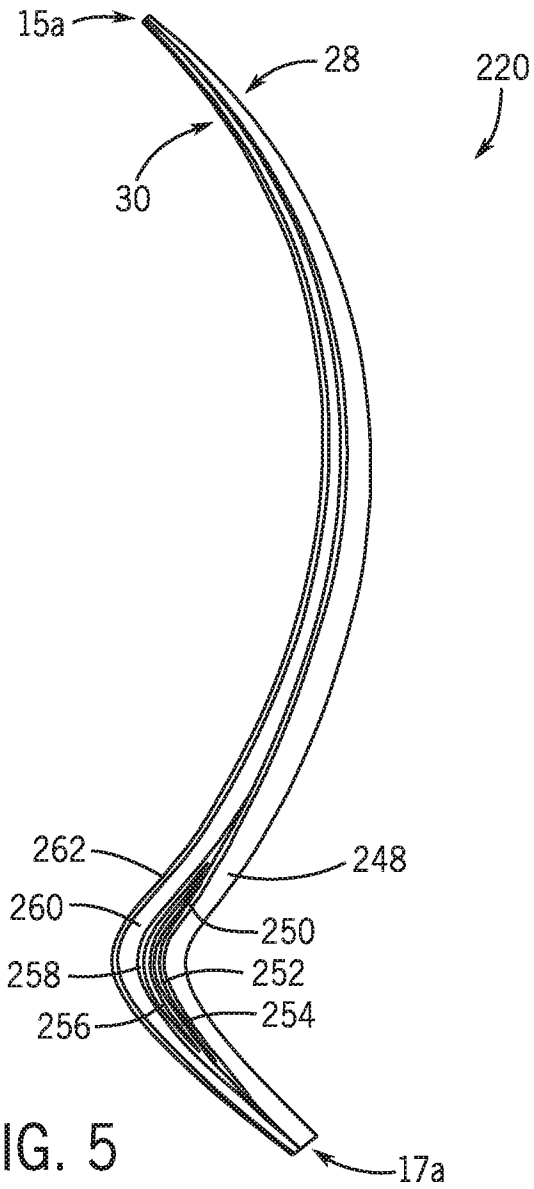

FIG. 5 illustrates a cross section of another alternative embodiment of a bra cup 220 according to the present disclosure. In this example, the layers of the bra cup 220 will be referred to generically, as the layers may be either fabric or foam in different examples. An outer layer of the bra cup 220, denoted as 248, may be a spacer fabric. A layer 250 laminated to the inner surface of the spacer fabric outer layer 248 may be a fabric layer or a foam layer. If a fabric layer, the fabric may be made of polyester. Another layer 252, laminated to the inside surface of the layer 250, can be a foam layer or a stabilizer layer. If a stabilizer layer, the layer 252 is made of fabric. A layer 254 just next to the layer 252 can be a supportive foam layer. The support component is shown at 256. Another supportive foam layer 258 can be provided on the opposite side of the support component 256. Together, the layers 252, 254, 256, and 258 make up a support shelf assembly. As the inner layer, a foam layer can be provided at 260, which can be laminated to a liner fabric layer 262, which serves as the inner face of the bra cup 220. The outer layer 248 comprises the exposed outer side 28 of the bra cup 220, while the layer 262 comprises the entire inner side 30 of the bra cup 220 that contacts the wearer's skin. The foam or fabric layer shown at 250 extends almost for the entire height of the bra cup 220, but ends just before the upper edge 15*a* and the lower edge 17*a*. The foam layer shown at 260 extends for the entire height of the bra cup 220, but tapers in thickness at both the upper and lower edges 15*a*, 17*a* of the bra cup 220. The foam layers shown at 254 and 258 extend vertically only in the general area of the support component 256. The stabilizer fabric layer 252 extends only on one side of the support component 256, and generally only for the height of the support component 256.

Figure 6:
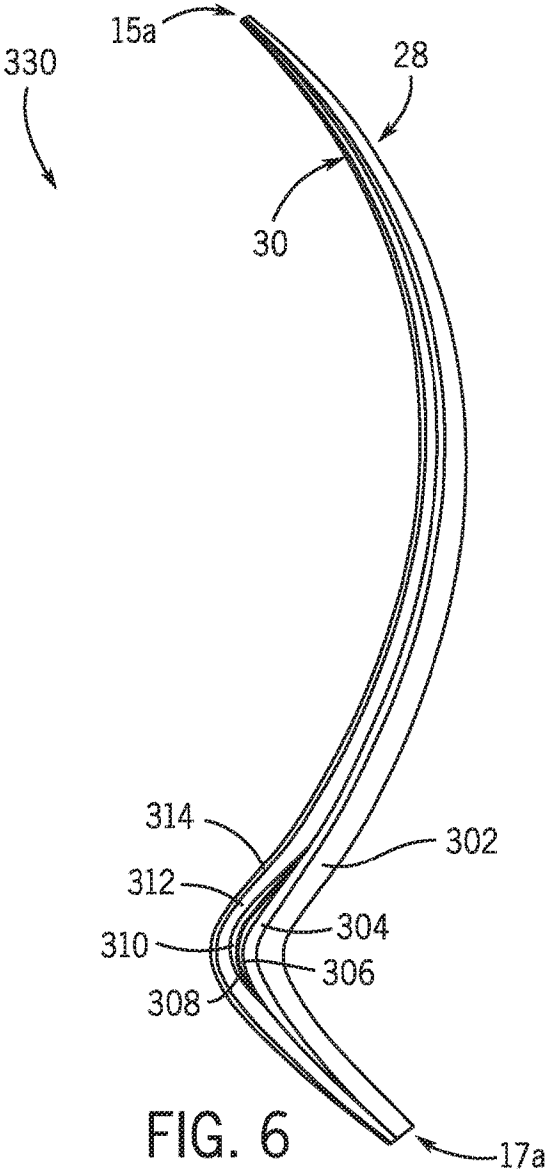

FIG. 6 shows a cross section of yet another example of a bra cup 330 according to the present disclosure. The bra cup 330 includes an outer layer 302 comprising a spacer fabric. A shaping foam layer 304 is situated on an inner face of the spacer fabric outer layer 302. An inner layer of the bra cup 330 includes a fabric liner 314 laminated to foam 312. A support shelf assembly is made of a support component 306, a stabilizer fabric layer 308, and a supportive foam layer 310. In one example, the stabilizer fabric layer 308 comprises one layer of stabilizer fabric. In another example, two layers of stabilizer fabric may be provided for extra support, such as for use in a bra having a large cup size. The two layers of stabilizer fabric can be provided face-to-face, or one layer of stabilizer fabric can be provided on each side of the support component 306. Together, the support component 306 and layers 308 and 310 make up a support shelf assembly.

Figure 7:
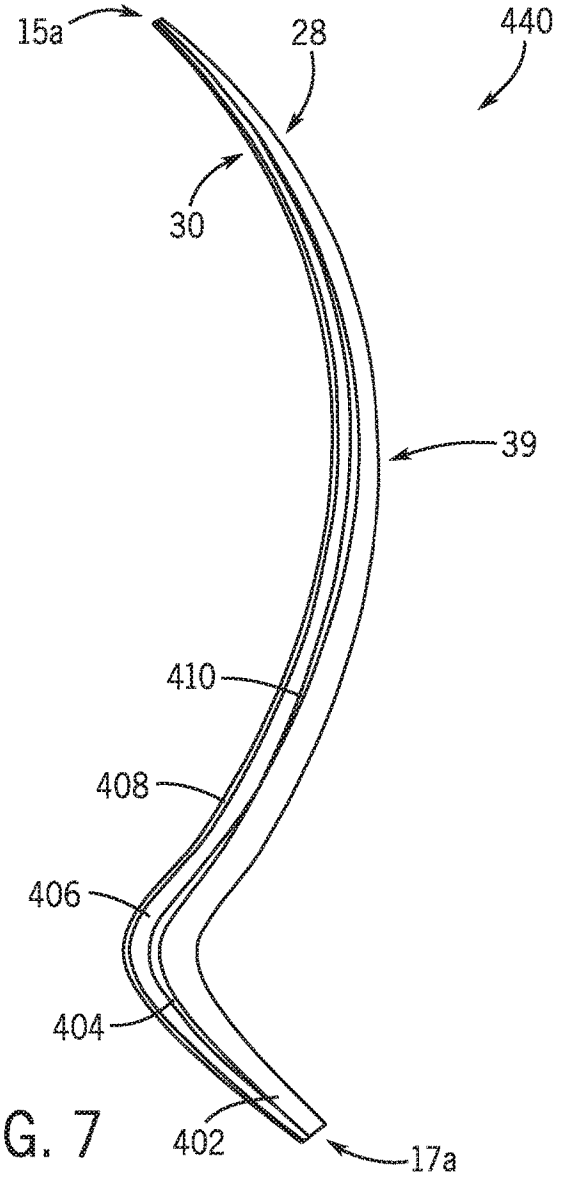

FIG. 7 shows a cross section of yet another alternative embodiment of a bra cup 440. In this example, an outer layer 402 comprises a spacer fabric. A stabilizer fabric, which can be provided in one or multiple layers, is shown at 404. The inner layer of the bra cup 440 comprises foam 406 laminated to a liner fabric layer 408. The bra cup 440 is also provided with a covering foam layer 410 near the apex 39, which provides padding to prevent nipple show-through. This bra cup 440 may be used in a bra having a small cup size, as it lacks a plastic support component.

Figure 11:
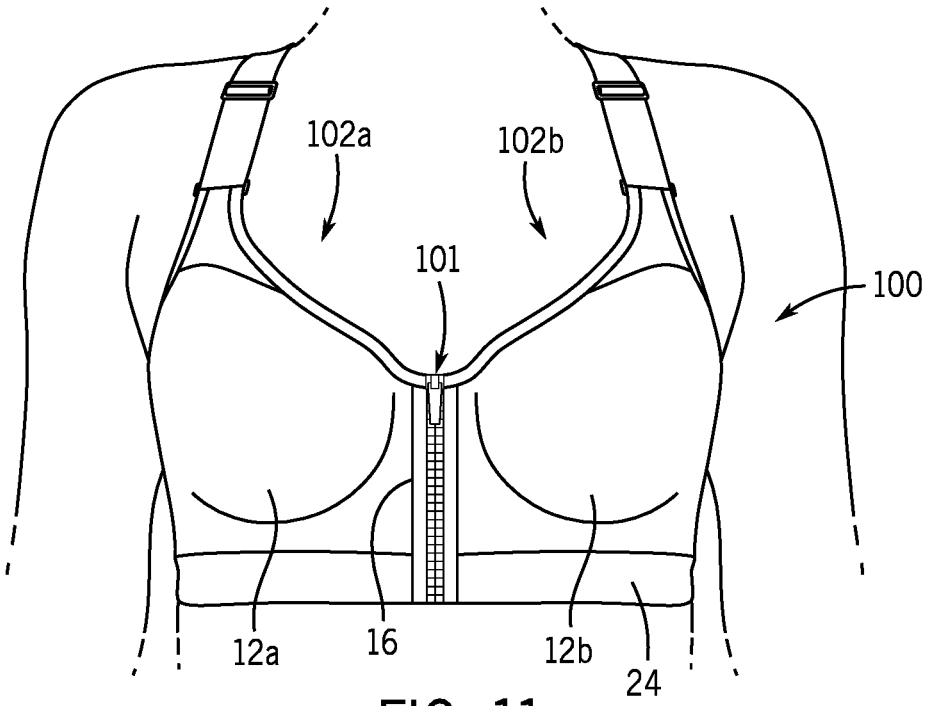
FIG. 11 illustrates an alternative embodiment of a sports bra according to the present disclosure as worn by a wearer.

FIG. 10 shows one example of the sports bra 10 of the present disclosure as worn on a wearer, wherein one bra cup 12*a*, 12*b* supports each of her breasts. FIG. 11 shows an alternative example of a sports bra 100. The front panel of the bra 100 comprises two lateral halves 102*a*, 102*b*, each half of the front panel comprising one of the bra cups 12*a* or 12*b*. In this example, the sports bra 100 includes a front closure, which here is a zipper 101. The zipper 101 on the center gore 16 couples the two halves 102*a*, 102*b* of the front panel together. A back connector 26 (see FIG. 2) may or may not be provided in addition to the front zipper 101. Other types of front closures, such as hook and eye closures, Velcro, snaps, etc. could be provided. Both of the sports bras 10, 100 may have front panels 11 with bra cups 12*a*, 12*b* as described with respect to FIGS. 1, 3, and 8, or front panels with bra cups like those described with respect to FIGS. 4-7 and 9. If the bra cups 12*a*, 12*b* are formed as described with respect to FIGS. 1, 3, and 8 (the first embodiment), note that each bra cup 12*a*, 12*b* includes an inner layer 50, outer layer 52, and shaping foam layer 54 and a stabilizer fabric layer 64 and first supportive foam layer 66 of a support shelf assembly 56 that span across a center gore 16 that connects the bra cups 12*a*, 12*b* and together form a front panel 11 of the bra 10, 100. In other words, the front-close sports bra 100 of FIG. 11 could be made by molding layers of single, continuous pieces of fabric and foam that span across both bra cups 12*a*, 12*b*, and later cutting those foam and fabric layers into halves 102*a*, 102*b* after the front panel of the bra 100 has been molded. In an alternative embodiment, the sports bra 100 can be formed by molding previously-cut layers of foam and fabric according to the above-described cross-sections into separate lateral halves 102*a*, 102*b* of the front panel.

In either of the bras of FIG. 10 or 11, the support component could be the undulating, W-shaped molded body 62 shown in FIG. 8, which because it is plastic, is easily cut to form the lateral halves 102*a*, 102*b* of the sports bra 100. Alternatively, the support component could be the separate, U-shaped components 138*a*, 138*b* shown in FIG. 9, which would obviate the need to cut the support component when cutting the center gore 16 to create the two lateral halves 102*a*, 102*b* of the front panel. Note that the separate support component halves 138*a*, 138*b* might be used even in the sports bra 10, which is not separable at the center gore 16. Both of the sports bras 10, 100 allow for a plunging neckline while still providing good support that controls and contains the wearer's breasts. The bras 10, 100 deliver on maximum support with less construction, and yet remain lightweight due to inclusion of a plastic support shelf and a spacer fabric.

Figure 12:
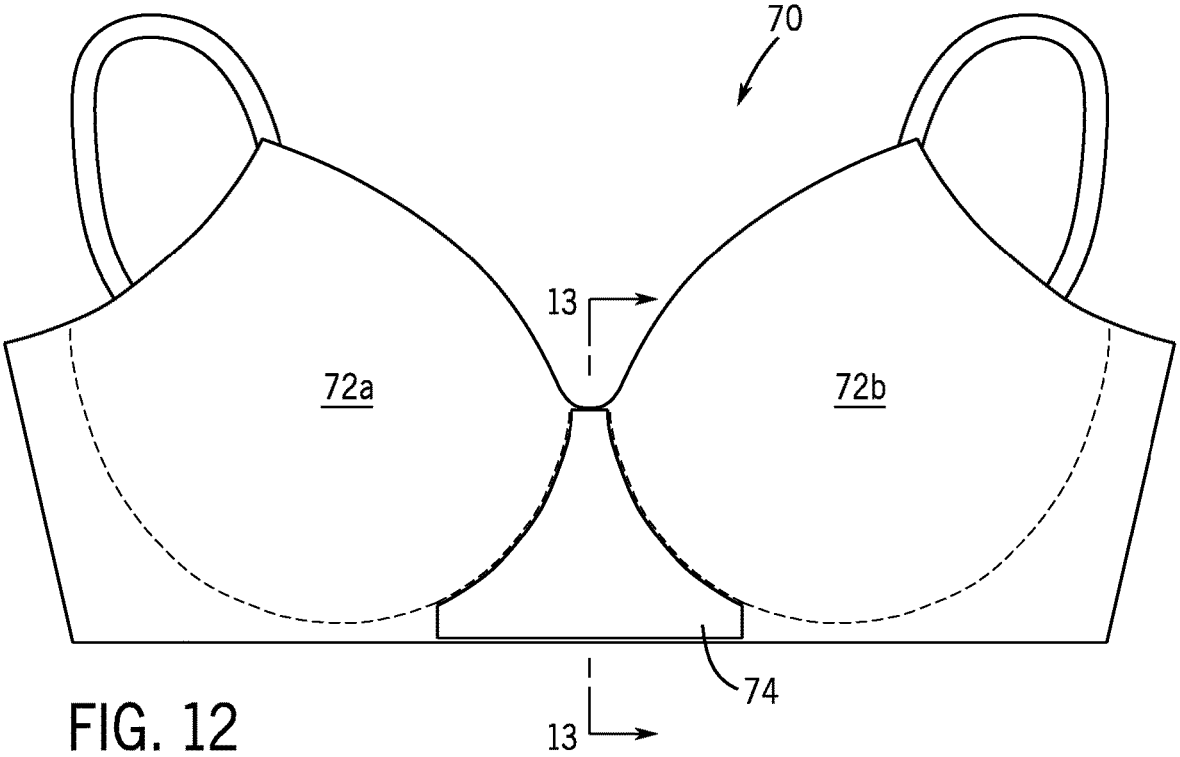
FIG. 12 illustrates a lingerie-type bra according to the present disclosure.
Figure 13:
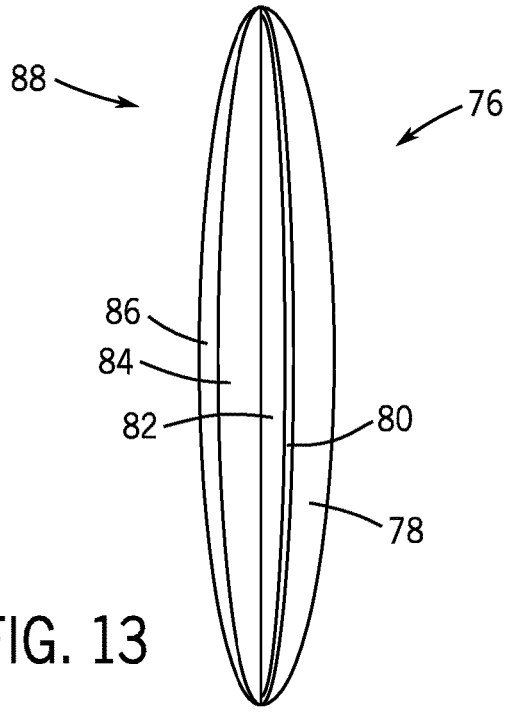
FIG. 13 illustrates a cross-sectional view of the area noted in FIG. 12.

FIG. 12 shows an example of a lingerie-type bra 70 according to the present disclosure. The bra 70 also includes two bra cups 72*a*, 72*b*, which are connected by a center gore 74. The cross section of both of the bra cups 72*a*, 72*b* can be that shown and described with respect to any of FIGS. 3-7, it being understood that the relative height and thickness of the support shelf assemblies shown therein might not be as high or as thick as those shown for purposes of the sports bras 10, 100. A center gore 74 corresponding to the exemplary bra cup 110 of FIGS. 4 and 9 is shown in cross section in FIG. 13 Similar to the bra cups 72*a*, 72*b*, the outer side 76 of the center gore 74 comprises a spacer fabric, as shown at 78. The spacer fabric 78 may be coextensive (integral) with the spacer fabric of the bra cups 72*a*, 72*b*. A stabilizer fabric layer, which provides relative stiffness to the center gore 74, is shown at 80. The stabilizer fabric layer 80 can be, for example, 100% polyester weft knit interlock with a weight of 100 g/m$^2$ and 48 courses per inch and 48 wales per inch (28 gauge) and can be coextensive (integral) with stabilizer fabric layer 146 shown in FIGS. 4 and 9. A foam layer is shown at 82. This foam layer 82 can be coextensive (integral) with corresponding supportive foam layer 144. Another foam layer is shown at 84, which can be coextensive (integral) with corresponding foam 142. At an inner side 88 of the center gore 74, a fabric liner 86 is provided, which can be coextensive (integral) with the liner fabric 140. It should be understood that if the cup cross sections of FIG. 3 or 5-7 are instead used, the center gore 74 would have corresponding layers integral with the cup layers shown in those figures.

In the above description, certain terms have been used for brevity, clarity, and understanding. No unnecessary limitations are to be implied therefrom beyond the requirement of the prior art because such terms are used for descriptive purposes only and are intended to be broadly construed. The different articles and methods described herein above may be used in alone or in combination with other articles and methods. Various equivalents, alternatives and modifications are possible within the scope of the appended claims. Each limitation in the appended claims is intended to invoke interpretation under 35 USC § 112(f) only the terms "means for" or "step for" are explicitly recited in the respective limitation. The scope of this disclosure is not intended to be bound by the literal order or literal content of method steps described herein, and non-substantial differences or changes still fall within the scope of the disclosure.

What is claimed is:

1. A front panel for a brassiere, the front panel comprising:
- a pair of bra cups, each bra cup in the pair of bra cups configured to hold one of a wearer's breasts;
- an inner layer of each bra cup configured to contact the wearer's skin;
- an outer layer of each bra cup opposing the inner layer; and
- a support shelf assembly between the inner and outer layers and spanning across at least a lower portion of each bra cup, the support shelf assembly comprising:
- a plastic support component located proximate a lower edge of each respective bra cup;
- a non-stretch stabilizer fabric layer spanning between both bra cups and along a full length of the support component; and a first supportive foam layer spanning between both bra cups and along the support component; and a shaping foam layer sandwiched between the outer layer and the inner layer of each bra cup, wherein the shaping foam layer extends from the lower edge of each bra cup to an upper edge of each bra cup;

wherein the inner layer, the outer layer, the support shelf assembly, and the shaping foam layer are molded together such that the support shelf assembly is an embedded, integral part of the front panel, and during the molding process, the support component is directly fused to at least one of the stabilizer fabric layer and the first supportive foam layer on either side of the support component; and wherein the inner and outer layers and the shaping foam layer of each bra cup and the first supportive foam layer and the stabilizer fabric layer of the support shelf assembly all extend below a lower edge of the support component.

2. The front panel of claim 1, further comprising a covering foam layer sandwiched between the shaping foam layer and the inner layer of each bra cup, wherein the covering foam layer is centered at an apex of each bra cup.

3. The front panel of claim 1, wherein the support shelf assembly further comprises a second supportive foam layer spanning between both bra cups and along the support component, the second supportive foam layer being located on an opposite side of the support component than the first supportive foam layer.

4. The front panel of claim 1, wherein the stabilizer fabric layer and the first supportive foam layer of the support shelf assembly both have an undulating shape configured to mimic a curvature of an underside of the wearer's breasts.

5. The front panel of claim 4, wherein the stabilizer fabric layer is a single, continuous layer of material spanning both of the bra cups.

6. The front panel of claim 5, wherein the first supportive foam layer is a single, continuous layer of material spanning both of the bra cups and extending along the full length of the support component.

7. The front panel of claim 1, wherein the support component is an undulating, W-shaped molded body configured to support an underside of the wearer's breasts.

8. The front panel of claim 1, wherein:

the inner layer of each bra cup comprises an inner liner fabric laminated to an inner foam layer, and the inner liner fabric is configured to contact the wearer's skin; and the outer layer of each bra cup comprises a spacer fabric.

9. The front panel of claim 1, wherein the stabilizer fabric layer of the support shelf assembly comprises 100% polyester.

10. The front panel of claim 1, wherein the front panel comprises two lateral halves, each half of the front panel comprising a respective one of the pair of bra cups, and further comprising a zipper that couples the two halves of the front panel together.

11. The front panel of claim 10, wherein the support component comprises two lateral halves, each half of the support component being a U-shaped molded body configured to support an underside of a respective one of the wearer's breasts.

12. The front panel of claim 1, wherein the inner and outer layers and the shaping foam layer of each bra cup and at least the first supportive foam layer and the stabilizer fabric layer of the support shelf assembly all extend to the lower edge of each bra cup.

13. The front panel of claim 1, wherein the stabilizer fabric layer is made of 100% polyester weft knit interlock.

14. A brassiere comprising the front panel of claim 1.

* * * * *